US011024966B2

(12) United States Patent
Jiao

(10) Patent No.: US 11,024,966 B2
(45) Date of Patent: Jun. 1, 2021

(54) ANTENNA AND TERMINAL DEVICE HAVING SAME

(71) Applicant: BEIJING XIAOMI MOBILE SOFTWARE CO., LTD., Beijing (CN)

(72) Inventor: Tao Jiao, Beijing (CN)

(73) Assignee: BEIJING XIAOMI MOBILE SOFTWARE CO., LTD., Beijing (CN)

( * ) Notice: Subject to any disclaimer, the term of this patent is extended or adjusted under 35 U.S.C. 154(b) by 12 days.

(21) Appl. No.: 16/699,099

(22) Filed: Nov. 28, 2019

(65) Prior Publication Data

US 2020/0176871 A1 Jun. 4, 2020

(30) Foreign Application Priority Data

Nov. 30, 2018 (CN) ..... 201811458116.4

(51) Int. Cl.

| | |
|---|---|
| ***H01Q 21/00*** | (2006.01) |
| ***H01Q 5/335*** | (2015.01) |
| ***H01Q 1/24*** | (2006.01) |
| ***H01Q 1/48*** | (2006.01) |
| *H01Q 7/00* | (2006.01) |
| *H01Q 9/42* | (2006.01) |

(52) U.S. Cl.

CPC ..... *H01Q 5/335* (2015.01); *H01Q 1/24* (2013.01); *H01Q 1/48* (2013.01); *H01Q 7/00* (2013.01); *H01Q 9/42* (2013.01)

(58) Field of Classification Search

CPC ..... H01Q 5/335; H01Q 1/24; H01Q 1/48; H01Q 7/00; H01Q 9/42; H01Q 5/328; H01Q 1/44; H01Q 21/28; H01Q 1/243; H01Q 1/36; H01Q 1/50; H04M 1/026

USPC ..... 343/728

See application file for complete search history.

(56) References Cited

U.S. PATENT DOCUMENTS

| | | | | |
|---|---|---|---|---|
| 9,203,140 | B2 * | 12/2015 | Yong | H01Q 1/42 |
| 9,653,782 | B2 * | 5/2017 | Chen | H01Q 5/371 |
| 10,270,173 | B2 * | 4/2019 | Wu | H01Q 9/0421 |
| 10,374,287 | B2 * | 8/2019 | Wu | H01Q 1/2291 |

(Continued)

FOREIGN PATENT DOCUMENTS

CN 103346397 B 1/2016

OTHER PUBLICATIONS

European Patent Office, Extended European Search Report mailed in Application No. 19212157.2, dated Apr. 3, 2020, Germany, 10 pages.

*Primary Examiner* — Jean B Jeanglaude
(74) *Attorney, Agent, or Firm* — Syncoda LLC; Feng Ma

(57) ABSTRACT

An antenna includes first and second feed points spaced apart at a same side of a device main body, and a first grounding point in a receiving area. The first and second feed points and the first grounding point are respectively electrically connected with a first contact point at a first frame, a second contact point at a second frame, and a third contact point at the first frame and a fourth contact point on the main body. An electrical connection body including the first feed point, the first and third contact points, the first grounding point, and the fourth contact point constitutes a first antenna. An electrical connection body including the second feed point, the second contact point, and junction point of the second frame and the main body constitutes a second antenna. The first grounding point is adjacent to the second antenna.

18 Claims, 5 Drawing Sheets

(56) References Cited

U.S. PATENT DOCUMENTS

| | | | | |
|---|---|---|---|---|
| 10,804,612 | B2 * | 10/2020 | Wu | G06F 1/1616 |
| 2011/0181480 | A1 * | 7/2011 | Hsieh | H01Q 1/243 343/767 |
| 2014/0062801 | A1 * | 3/2014 | Yong | H01Q 9/42 343/702 |
| 2016/0181694 | A1 * | 6/2016 | Chen | H01Q 1/243 343/700 MS |
| 2017/0047639 | A1 | 2/2017 | Lee et al. | |
| 2017/0048363 | A1 | 2/2017 | Lee et al. | |
| 2017/0117614 | A1 * | 4/2017 | Wu | H01Q 1/36 |
| 2017/0271768 | A1 * | 9/2017 | Wu | H01Q 9/0421 |
| 2018/0034148 | A1 | 2/2018 | Nam et al. | |
| 2018/0062244 | A1 | 3/2018 | Huang et al. | |
| 2018/0131092 | A1 | 5/2018 | Liou | |
| 2018/0342809 | A1 * | 11/2018 | Wu | H01Q 1/2266 |

* cited by examiner

ANTENNA AND TERMINAL DEVICE HAVING SAME

CROSS-REFERENCE TO RELATED APPLICATION

This application claims priority to Chinese Patent Application No. 201811458116.4 filed on Nov. 30, 2018, the disclosure of which is hereby incorporated herein by reference in its entirety.

BACKGROUND

In the field of terminal devices, such as mobile phones and other mobile terminals, with the development trend of full screens and narrow bezels, and the increasing number of antennas in terminal devices, the working space for the antennas in the terminal device has become more limited.

SUMMARY

The present disclosure relates to the field of communications, and more specifically to an antenna and a terminal device having the same.

According to a first aspect of the present disclosure, there is provided an antenna, applicable in a terminal device having a metal body, where the antenna includes a first feed point, a second feed point and a first grounding point. The metal body includes a main body and a frame structure connected with the main body. The main body and the frame structure enclose a space to form a receiving area. The frame structure is provided with two slots spaced apart on a bottom thereof, and the two slots divide the frame structure into a first frame, a second frame and a third frame. The second frame and the third frame are disposed respectively on two sides of the first frame. The first feed point and the second feed point are spaced apart from each other in a same side of the main body, and the first grounding point is disposed in the receiving area. The first feed point is electrically connected with a first contact point on the first frame, the second feed point is electrically connected with a second contact point on the second frame; and the first grounding point is electrically connected with a third contact point of the first frame and is also electrically connected with a fourth contact point of the main body. An electrical connection body including the first feed point, the first contact point, the third contact point, the first grounding point, and the fourth contact point constitutes a first antenna, and an electrical connection body including the second feed point, the second contact point, and a junction point of the second frame and the main body constitutes a second antenna. The first grounding point is disposed adjacent to the second antenna.

According to a second aspect of the present disclosure, there is provided a terminal device including a metal body, where the metal body includes a main body and a frame structure connected with the main body. The main body and the frame structure enclose a space to form a receiving area. The frame structure is provided with two slots spaced apart on a bottom thereof, and the two slots divide the frame structure into a first frame, a second frame and a third frame. The second frame and the third frame are disposed respectively on two sides of the first frame. An end of the second frame away from the first frame is connected with one side of the main body, and an end of the third frame away from the first frame is connected with the other side of the main body. The first frame is provided with a first contact point and a third contact point, the second frame is provided with a second contact point, and the main body is provided with a fourth contact point. The terminal device further includes an antenna according to the above aspect.

It is to be understood that the above general descriptions and the below detailed descriptions are merely exemplary and explanatory, and are not intended to limit the present disclosure.

BRIEF DESCRIPTION OF DRAWINGS

The accompanying drawings referred to in the specification are a part of this disclosure, and provide illustrative embodiments consistent with the disclosure and, together with the detailed description, serve to illustrate some embodiments of the disclosure.

DETAILED DESCRIPTION

Figure 1:
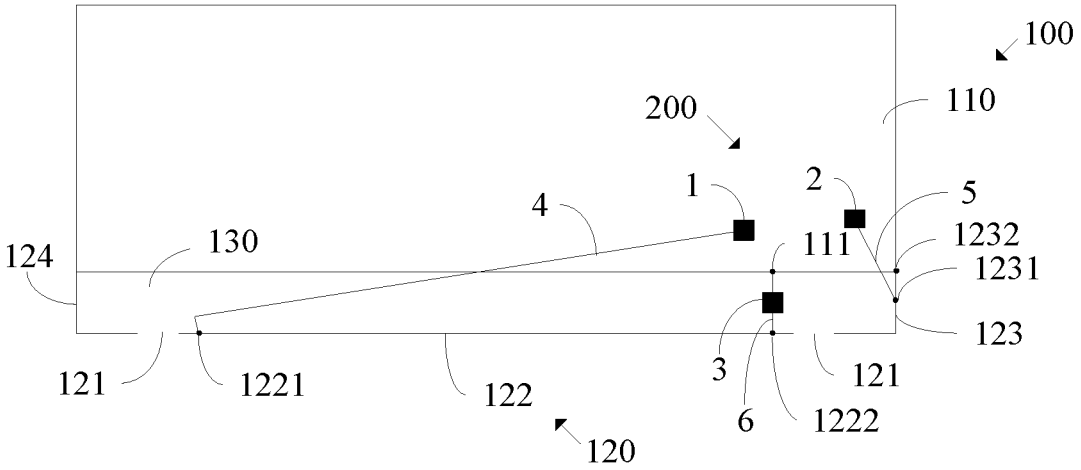
FIG. 1 is a schematic structural diagram of an antenna according to some embodiments of the present disclosure.

Examples will be described in detail herein, with the illustrations thereof represented in the drawings. When the following descriptions involve the drawings, like numerals in different drawings refer to like or similar elements unless otherwise indicated. The embodiments described in the following examples do not represent all embodiments consistent with the present disclosure. Rather, they are merely examples of apparatuses and methods consistent with some aspects of the present disclosure as detailed in the appended claims.

The terms used in the present disclosure are for the purpose of describing particular examples only, and are not intended to limit the present disclosure. Terms determined by "a," "the" and "said" in their singular forms in the present disclosure and the appended claims are also intended to include plurality, unless clearly indicated otherwise in the context. It should also be understood that the term "and/or" as used herein is and includes any and all possible combinations of one or more of the associated listed items.

It is to be understood that, although terms "first," "second," "third" and the like may be used in the present disclosure to describe various information, such information should not be limited to these terms. These terms are only used to distinguish one category of information from another. For example, without departing from the scope of the present disclosure, first information may be referred as second information; and similarly, second information may also be referred as first information. Depending on the context, the word "if" as used herein may be interpreted as "when" or "upon" or "in response to determining".

Various embodiments of the present disclosure can improve performance of antennas working in restricted spaces. As the bandwidth of the terminal device becomes increasingly wider, the requirements on the environment become ever more demanding and the bezels become narrower, it may be difficult for a single antenna to cover the entire frequency band. Dual antennas have found more applications. However, it is desired to further improve isolation and efficiency of the dual antennas.

FIG. 1 is a schematic structural diagram of an antenna according to some embodiments of the present disclosure. The antenna of this example is applied to a terminal device having a metal body, and the terminal device can be a mobile terminal, such as a mobile phone, a tablet computer or the like, or can be a fixed terminal.

Referring to FIG. 1, the metal body 100 of the terminal device may include a main body 110 and a frame structure 120 connected with the main body 110. The main body 110 and the frame structure 120 enclose a space to form a receiving area 130. The frame structure 120 is provided with two slots 121 on a bottom thereof, and the two slots 121 are spaced apart. In the example, the two slots 121 divide the frame structure 120 into a first frame 122, a second frame 123, and a third frame 124. The second frame 123 and the third frame 124 are disposed respectively on two sides of the first frame 122. Further, in the example, the first frame 122 is provided with a first contact point 1221 and a third contact point 1222, the second frame 123 is provided with a second contact point 1231, and the main body 110 is provided with a fourth contact point 111.

Taking the terminal device being a mobile phone as an example, the metal body 100 is a middle frame of the mobile phone, and the bottom of the frame structure 120 refers to a bottom of the mobile phone. The shape and size of the slots 121 can be set according to design requirements of the mobile phone.

In this example, the main body 110 and the frame structure 120 are all metal parts. The main body 110 has a cuboid or cubic structure, and the frame structure 120 is connected with both sides of the bottom of the main body 110. Specifically, the second frame 123 is connected with one side of the main body 110, and the third frame 124 is connected with the other side of the main body 110. In this example, one end of the second frame 123 away from the slot 121 (the slot 121 between the first frame 122 and the second frame 123) is connected with one side of the main body 110, and one end of the third frame 124 away from the slot 121 (the slot 121 between the first frame 122 and the third frame 124) is connected with the other side of the main body 110.

In this example, the receiving area 130 can be a quadrilateral area, such as a rectangular area, a square area, or an area of other shapes.

Referring to FIG. 1, the antennas 200 may include a first feed point 1, a second feed point 2, and a first grounding point 3. The first feed point 1 and the second feed point 2 are provided in the same side of the main body 110 (as shown in FIG. 1, the right half of the main body 110) and spaced apart from each other, and the first grounding point 3 is disposed in the receiving area 130. In this example, the first feed point 1 is electrically connected with the first contact point 1221, the second feed point 2 is electrically connected with the second contact point 1231, and the first grounding point 3 is electrically connected with the third contact point 1222, and is also electrically connected with the fourth contact point 111 on the main body 110.

An electrical connection body formed by the first feed point 1, the first contact point 1221, the third contact point 1222, the first grounding point 3, and the fourth contact point 111 constitutes a first antenna, and an electrical connection body formed by the second feed point 2, the second contact point 1231, and a junction point 1232 of the second frame 123 and the main body 110 constitutes a second antenna. In addition, the first grounding point 3 of the example is disposed adjacent to the second antenna.

In the example of the present disclosure, the first feed point 1 and the second feed point 2 of the dual antenna 200 are provided in the same side of the main body 110 and spaced apart from each other, the first frame 122 is used to implement the first antenna, the second frame 123 is used to implement the second antenna, and an end of the first antenna adjacent to the second antenna is grounded, which improves the isolation between the first antenna and the second antenna and radiation efficiencies of the first antenna and the second antenna.

Optionally, the first feed point 1 and the second feed point 2 are spaced apart and disposed in one side of the main body 110 adjacent to the second frame 123 (that is, right half of the main body 110). Optionally, the first feed point 1 and the second feed point 2 are spaced apart and disposed in one side of the main body 110 adjacent to the third frame 124 (that is, left half of the main body 110). This example is further described by taking the first feed point 1 and the second feed point 2 being spaced apart and disposed in one side of the main body 110 adjacent to the second frame 123 as an example.

Referring to FIG. 1, in this example, the first grounding point 3 is disposed over an end of the first frame 122 adjacent to the second frame 123.

The position of the first contact point 1221 and the third contact point 1222 on the first frame 122 can be selected according to design requirements on performance such as frequency band of the first antenna.

Referring to FIG. 1, in this example, the first contact point 1221 is disposed at an end of the first frame 122 adjacent to the third frame 124, and the third contact point 1222 is disposed at an end of the first frame 122 adjacent to the second frame 123.

The position of the second contact point 1231 on the second frame 123 can be selected according to design requirements on performance such as frequency band of the second antenna. Optionally, the second contact point 1231 is disposed on a side of the second frame 123 away from the first frame 122.

In addition, in this example, the fourth contact point 111 is spaced apart from the first feed point 1 and the second feed point 2, respectively. Referring to FIG. 1 again, in this example, the fourth contact point 111 is disposed on a side of the main body 110 facing the receiving area 130. Of course, the fourth contact point 111 may also be disposed at other positions of the main body 110, and specifically, the position of the fourth contact point 111 on the main body 110 can be selected according to design requirements on performance such as the frequency band of the first antenna, the isolation between the first antenna and the second antenna, and the like.

In this example, the antenna 200 further includes a first trace 4, a second trace 5, and a third trace 6. The first feed point 1 is electrically connected with the first contact point 1221 through the first trace 4, and the second feed point 2 is electrically connected with the second contact point 1231 through the second trace 5, and the first grounding point 3 is electrically connected with the third contact point 1222 and the fourth contact point 111 through the third trace 6.

The shape and size of the first trace 4 and the shape and size of the third trace 6 can be selected according to design requirements on performance such as the frequency band of the first antenna, and the shape and size of the second trace 5 can be selected according to design requirements on performance such as the frequency band of the second antenna.

Referring also to FIG. 1, the first trace 4 may include a first segment and a second segment. The first segment is connected with the first contact point 1221. The second segment has one end connected with one end of the first segment away from the first contact point 1221, and the other end connected with the first feed point 1. In this example, the first segment and the second segment are disposed as a bending member, that is, a certain angle is formed between the first segment and the second segment. By adopting such a configuration, the performance of the first antenna can be improved. Optionally, the first segment is perpendicularly connected with the first frame 122. Referring to FIG. 1, in this example, the third trace 6 is perpendicularly connected with a side of the first frame 122 and the main body 110 facing the receiving area 130, respectively.

In some embodiments, a frequency range of the first antenna is (800 MHz, 2170 MHz). That is, the frequency band of the first antenna is greater than or equal to 800 MHz, and less than or equal to 2170 MHz, which can achieve coverage of low and intermediate frequency bandwidths. A frequency range of the second antenna is (2300 MHz, 2690 MHz). That is, the frequency band of the second antenna is greater than or equal to 2300 MHz, and less than or equal to 2690 MHz, which can achieve coverage of high frequency bandwidths.

The form of the first antenna and the second antenna can be designed as needed. For example, in some embodiments, the first antenna is in the form of a loop. Of course, the first antenna can also be designed in other forms as needed.

In some embodiments, the second antenna is in the form of an Inverted-F-Antenna (IFA). Of course, the second antenna can also be designed in other forms as needed.

In this example, the first antenna is in the form of a loop, and the second antenna is in the form of an IFA.

Figure 2:
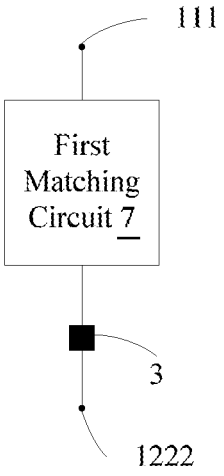
FIG. 2 is a detailed schematic diagram showing a partial structure of the antenna provided in FIG. 1.
Figure 3A:
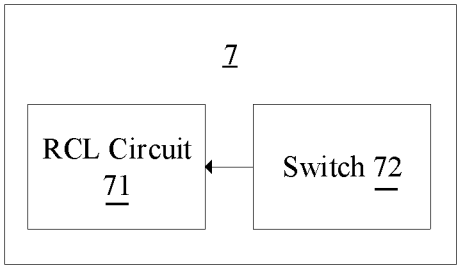
FIG. 3A is a block diagram showing a matching circuit of the antenna provided in FIG. 2.

Further, in this example, a first matching circuit 7 is connected in series between the first grounding point 3 and the third contact point 1222 and/or between the first grounding point 3 and the fourth contact point 111. Referring to FIG. 2, in some embodiments, a first matching circuit 7 is connected in series between the first grounding point 3 and the fourth contact point 111. Specifically, referring to FIG. 3A, the first matching circuit 7 may include a resistor-inductor-capacitor (RLC) circuit 71 and a switch 72 configured to control the RLC circuit 71. The RLC circuit 71 includes a resistor, a capacitor, and an inductor. By switching the RLC circuit 71 to different impedance levels with the switch 72, the first antenna can achieve coverage of low frequency bandwidths.

Figure 3B:
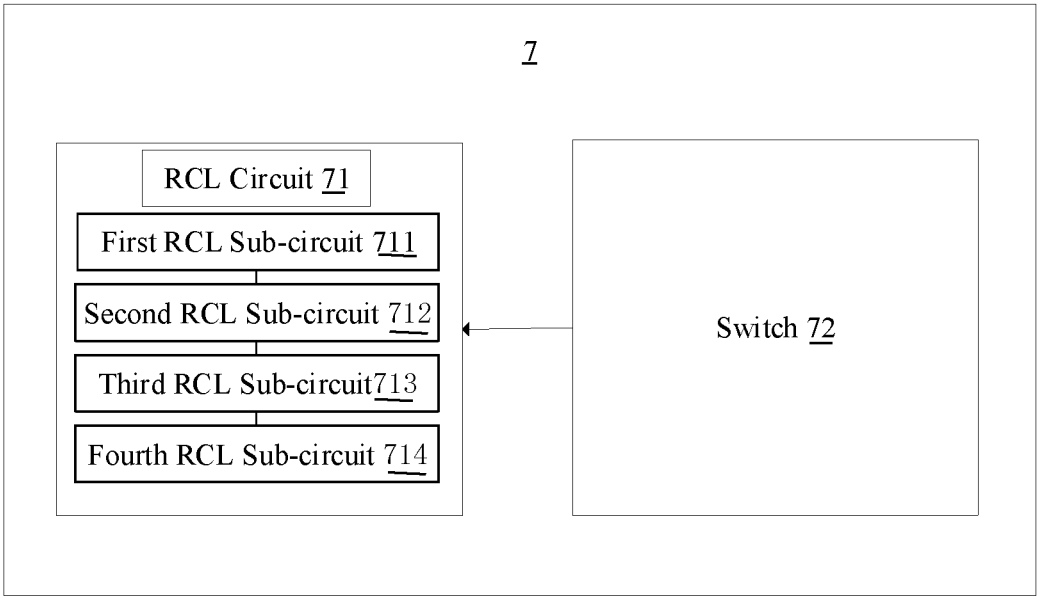
FIG. 3B is another block diagram showing a matching circuit of the antenna provided in FIG. 2.

In one specific example, referring to FIG. 3B, the RLC circuit 71 includes a first RLC sub-circuit 711, a second RLC sub-circuit 712, a third RLC sub-circuit 713, and a fourth RLC sub-circuit 714. The switch 72 is a single-pole four-throw switch, and the single-pole four-throw switch is used to control the first matching circuit 7 to select one or more of the first RLC sub-circuit 711, the second RLC sub-circuit 712, the third RLC sub-circuit 713, and the fourth RLC sub-circuit 714.

Optionally, the first RLC sub-circuit 711, the second RLC sub-circuit 712, the third RLC sub-circuit 713, and the fourth RLC sub-circuit 714 have different impedances. By controlling one of the first RLC sub-circuit 711, the second RLC sub-circuit 712, the third RLC sub-circuit 713, and the fourth RLC sub-circuit 714 to be switched on and connected in series between the first grounding point 3 and the fourth contact point 111 with the single-pole four-throw switch, the frequency bands of the first antenna can fully cover low and intermediate frequency bandwidths.

Figure 4:
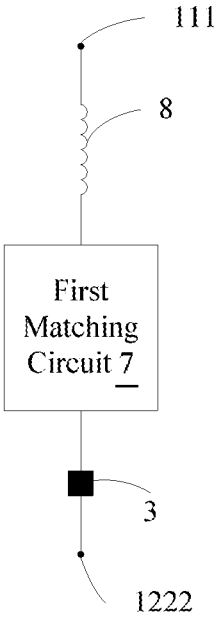
FIG. 4 is another detailed schematic diagram showing a partial structure of the antenna provided in FIG. 1.

In some embodiments, referring to FIG. 4, the antenna 200 may further include a tuning inductor 8. The first matching circuit 7 is connected in series with the tuning inductor 8 between the fourth contact point 111 and the first grounding point 3 to shift the resonance frequency of the first antenna at 2170 MHz to lower frequency, thereby increasing the isolation between the first antenna and the second antennas.

In addition, the second antenna may include a second matching circuit between the fourth contact point 111 and the second contact point 1231. The bandwidth and frequency offset of the second antenna can be adjusted by adjusting the position of the second contact point 1231 on the second frame 123 and adjusting the second matching circuit of the second antenna.

Figure 5:
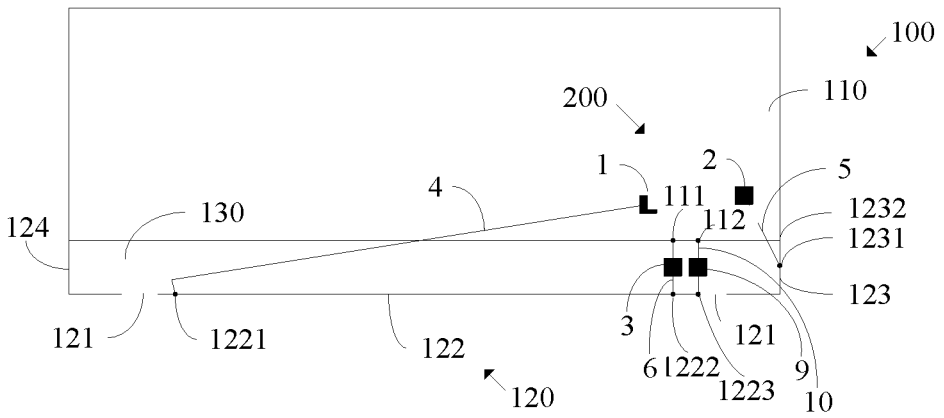
FIG. 5 is a schematic structural diagram of another antenna according to some embodiments of the present disclosure.

To further optimize the isolation between the first antenna and the second antenna, referring to FIG. 5, the antenna 200 may further include a second grounding point 9. The second grounding point 9 is disposed in the receiving area 130, and spaced apart from the first grounding point 3. The second grounding point 9 is electrically connected with a fifth contact point 1223 of the first frame 122 and is electrically connected with a sixth contact point 112 of the main body 110.

Optionally, the second grounding point 9 is disposed between the first grounding point 3 and the second frame 123. Further, the fifth contact point 1223 is disposed between the third contact point 1222 and the second frame 123, and the sixth contact point 112 is disposed between the fourth contact point 111 and a junction point 1232 of the main body 110 and the second frame 123.

The position of the fifth contact point 1223 on the first frame 122 and the position of the sixth contact point 112 on the main body 110 can be selected according to design requirements on the isolation between the first antenna and the second antenna. Optionally, the fifth contact point 1223 is disposed at an end of the first frame 122 adjacent to the second frame 123. Optionally, the sixth contact point 112 can be disposed on a side of the main body 110 facing the receiving area 130.

Further, in this example, the antenna 200 also includes a fourth trace 10. The second grounding point 9 is electrically connected with the fifth contact point 1223 through the fourth trace 10, and is electrically connected to the sixth contact point 112 through the fourth trace 10. The size of the fourth trace 10 can be set according to design requirements on the isolation between the first antenna and the second antenna.

Figure 6:
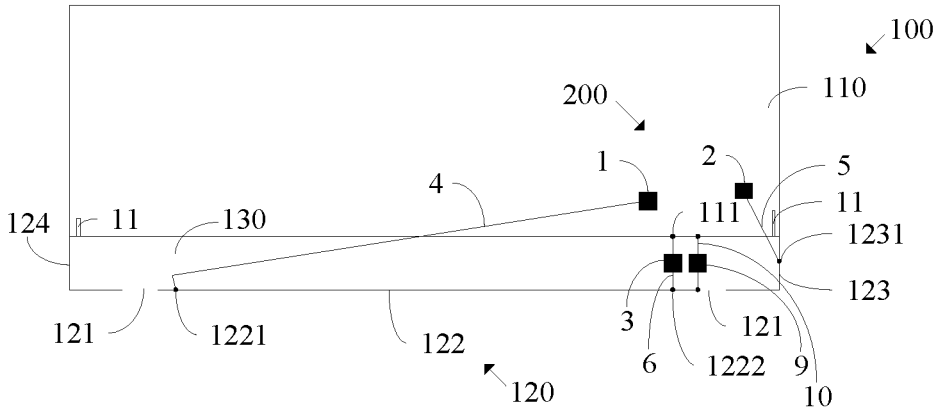
FIG. 6 is a schematic structural diagram of still another antenna according to some embodiments of the present disclosure.

Referring to FIG. 6, in some embodiments, the antenna 200 also includes a slit 11 disposed on a bottom side of the main body 110 and adjacent to the second frame 123 and/or the third frame 124. The opening of the slit 11 faces the receiving area. The slit 11 is provided to optimize the performance of the first antenna and the second antenna. The size of the slit 11 and the position of the slit 11 on the main body 110 can be set according to requirements on performance of the first antenna and the second antenna.

The material of each of the above traces can be copper or other metal such as silver, aluminum or some other suitable options. Optionally, the trace is made of copper foil. It is to be noted that the present disclosure does not limit the material of the trace, and any material capable of signal transmission is within the protection scope of the present disclosure. Each trace of the present disclosure is patterned in a corresponding region.

Figure 7:
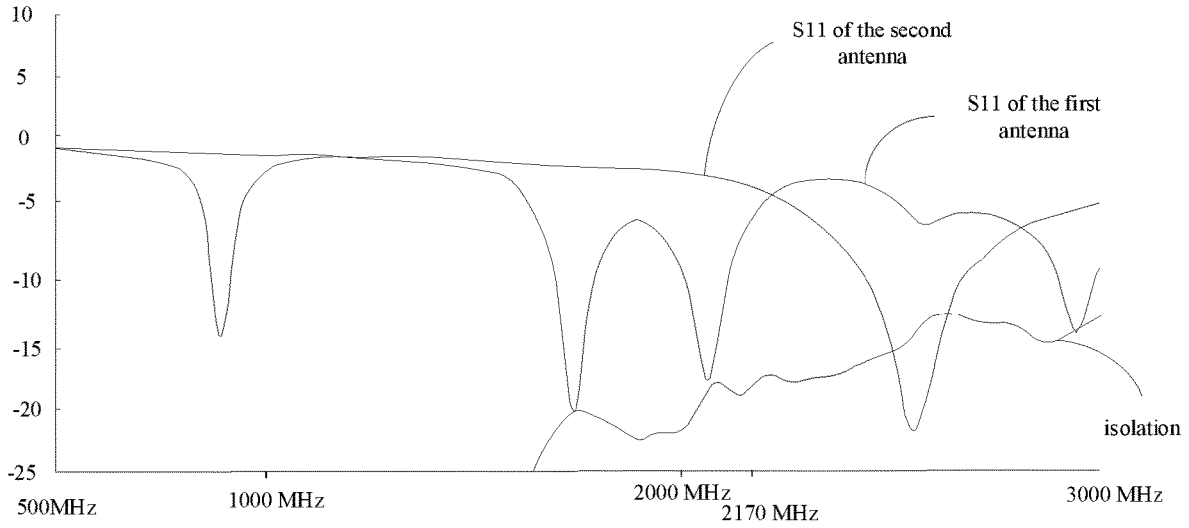
FIG. 7 is a graph showing performance of an antenna according to some embodiments of the present disclosure, illustrating S11 of a first antenna and a second antenna and isolation between the first antenna and the second antenna.

FIG. 7 is a graph showing the performance of the antenna according to some embodiments of the present disclosure. Si 1 (return loss characteristics) of the first antenna and the second antenna and isolation between the first antenna and the second antenna are illustrated. In the graph, the abscissa is the resonant frequency, and for S11, the ordinate is the value of Si 1 in dB, and for the isolation, the ordinate is the isolation value. From FIG. 7, it can be observed that the value of S11 of the first antenna and the second antenna are both relatively small, thus the radiation efficiencies of the first antenna and the second antenna are high. In addition, the smaller the isolation value is, the better the isolation is. It can also be observed from FIG. 7 that the third valley of the S11 curve of the first antenna corresponds to a resonant frequency of smaller than 2170 MHz. In a case where the first matching circuit 7 and the tuning inductor 8 are not included in the first antenna, the third valley of a corresponding S11 curve of the first antenna corresponds to a resonant frequency of 2170 MHz. Therefore, in the example of the present disclosure, the resonance frequency of the first antenna at 2170 MHz band is shifted to lower frequency, and the isolation between the first antenna and the second antenna is increased.

Various embodiments of the present disclosure can have one or more of the following advantages: by arranging the first feed point and the second feed point of the dual antenna together, implementing the first antenna with the first frame, implementing the second antenna with the second frame, and grounding the end of the first antenna adjacent to the second antenna, it can improve the isolation between the first antenna and the second antenna and the radiation efficiencies of the first antenna and the second antenna.

In the present disclosure, the terms "installed," "connected," "coupled," "fixed" and the like shall be understood broadly, and can be either a fixed connection or a detachable connection, or integrated, unless otherwise explicitly defined. These terms can refer to mechanical or electrical connections, or both. Such connections can be direct connections or indirect connections through an intermediate medium. These terms can also refer to the internal connections or the interactions between elements. The specific meanings of the above terms in the present disclosure can be understood by those of ordinary skill in the art on a case-by-case basis.

In the description of the present disclosure, the terms "one embodiment," "some embodiments," "example," "specific example," or "some examples," and the like can indicate a specific feature described in connection with the embodiment or example, a structure, a material or feature included in at least one embodiment or example. In the present disclosure, the schematic representation of the above terms is not necessarily directed to the same embodiment or example.

Moreover, the particular features, structures, materials, or characteristics described can be combined in a suitable manner in any one or more embodiments or examples. In addition, various embodiments or examples described in the specification, as well as features of various embodiments or examples, can be combined and reorganized.

While this specification contains many specific implementation details, these should not be construed as limitations on the scope of any claims, but rather as descriptions of features specific to particular implementations. Certain features that are described in this specification in the context of separate implementations can also be implemented in combination in a single implementation. Conversely, various features that are described in the context of a single implementation can also be implemented in multiple implementations separately or in any suitable subcombination.

Moreover, although features can be described above as acting in certain combinations and even initially claimed as such, one or more features from a claimed combination can in some cases be excised from the combination, and the claimed combination can be directed to a subcombination or variation of a subcombination.

It is intended that the specification and embodiments be considered as examples only. Other embodiments of the disclosure will be apparent to those skilled in the art in view of the specification and drawings of the present disclosure. That is, although specific embodiments have been described above in detail, the description is merely for purposes of illustration. It should be appreciated, therefore, that many aspects described above are not intended as required or essential elements unless explicitly stated otherwise.

Various modifications of, and equivalent acts corresponding to, the disclosed aspects of the example embodiments, in addition to those described above, can be made by a person of ordinary skill in the art, having the benefit of the present disclosure, without departing from the spirit and scope of the disclosure defined in the following claims, the scope of which is to be accorded the broadest interpretation so as to encompass such modifications and equivalent structures.

It should be understood that "a plurality" or "multiple" as referred to herein means two or more. "And/or," describing the association relationship of the associated objects, indicates that there may be three relationships, for example, A and/or B may indicate that there are three cases where A exists separately, A and B exist at the same time, and B exists separately. The character "/" generally indicates that the contextual objects are in an "or" relationship.

In the present disclosure, it is to be understood that the terms "lower," "upper," "under" or "beneath" or "underneath," "above," "front," "back," "left," "right," "top," "bottom," "inner," "outer," "horizontal," "vertical," and other orientation or positional relationships are based on example orientations illustrated in the drawings, and are merely for the convenience of the description of some embodiments, rather than indicating or implying the device or component being constructed and operated in a particular orientation. Therefore, these terms are not to be construed as limiting the scope of the present disclosure.

Moreover, the terms "first" and "second" are used for descriptive purposes only and are not to be construed as indicating or implying a relative importance or implicitly indicating the number of technical features indicated. Thus, elements referred to as "first" and "second" may include one or more of the features either explicitly or implicitly. In the description of the present disclosure, "a plurality" indicates two or more unless specifically defined otherwise.

In the present disclosure, a first element being "on" a second element may indicate direct contact between the first and second elements, without contact, or indirect geometrical relationship through one or more intermediate media or layers, unless otherwise explicitly stated and defined. Similarly, a first element being "under," "underneath" or "beneath" a second element may indicate direct contact between the first and second elements, without contact, or indirect geometrical relationship through one or more intermediate media or layers, unless otherwise explicitly stated and defined.

Some other embodiments of the present disclosure can be available to those skilled in the art upon consideration of the specification and practice of the various embodiments disclosed herein. The present application is intended to cover any variations, uses, or adaptations of the present disclosure following general principles of the present disclosure and include the common general knowledge or conventional technical means in the art without departing from the present disclosure. The specification and examples can be shown as illustrative only, and the true scope and spirit of the disclosure are indicated by the following claims.

The invention claimed is:

1. An antenna, applicable to a terminal device having a metal body, wherein the antenna comprises a first feed point, a second feed point and a first grounding point;

the metal body comprises a main body and a frame structure connected with the main body;

the main body and the frame structure enclose a space to form a receiving area;

the frame structure is provided with two slots spaced apart on a bottom thereof;

the two slots divide the frame structure into a first frame, a second frame and a third frame;

the second frame and the third frame are disposed respectively on two sides of the first frame;

the first feed point and the second feed point are spaced apart from each other in a same side of the main body;

the first grounding point is disposed in the receiving area;

the first feed point is electrically connected with a first contact point on the first frame;

the second feed point is electrically connected with a second contact point on the second frame;

the first grounding point is electrically connected with a third contact point on the first frame, and is also electrically connected with a fourth contact points on the main body; and an electrical connection body comprising the first feed point, the first contact point, the third contact point, the first grounding point, and the fourth contact point constitutes a first antenna, and an electrical connection body comprising the second feed point, the second contact point and a junction point of the second frame and the main body constitutes a second antenna, wherein the first grounding point is disposed adjacent to the second antenna;

a first matching circuit connected in series between the first grounding point and the third contact point and/or between the first grounding point and the fourth contact points; and a tuning inductor connected in series with the first matching circuit.

2. The antenna according to claim 1, wherein the first feed point and the second feed point are spaced apart in a side of the main body adjacent to the second frame, and the first grounding point is disposed over an end of the first frame adjacent to the second frame.

3. The antenna according to claim 2, wherein the first contact point is disposed at an end of the first frame adjacent to the third frame, and the third contact point is disposed at an end of the first frame adjacent to the second frame.

4. The antenna according to claim 3, wherein the second contact point is disposed on a side of the second frame away from the first frame.

5. The antenna according to claim 2, wherein the fourth contact point is spaced apart from the first feed point and the second feed point, respectively.

6. The antenna according to claim 5, wherein the fourth contact point is disposed at a side of the main body facing the receiving area.

7. The antenna according to claim 1, wherein the antenna further comprises a first trace, a second trace and a third trace;

the first feed point is electrically connected with the first contact point through the first trace, the second feed point is electrically connected with the second contact point through the second trace, and the first grounding point is electrically connected with the third contact point and the fourth contact point through the third trace.

8. The antenna according to claim 7, wherein the first trace comprises a first segment connected with the first contact point and a second segment connecting one end of the first segment away from the first contact point and the first feed point, and the first segment and the second segment are disposed as a bending member.

9. The antenna according to claim 1, wherein the first antenna has a frequency range of (800 MHz, 2170 MHz) and the second antenna has a frequency range of (2300 MHz, 2690 MHz).

10. The antenna according to claim 1, wherein the first antenna is in a form of a loop.

11. The antenna according to claim 1, wherein the second antenna is in a form of an Inverted-F-Antenna (IFA).

12. The antenna according to claim 1, wherein the first matching circuit comprises a resistor-inductor-capacitor (RLC) circuit and a switch configured to control the RLC circuit, and the RLC circuit comprises a resistor, a capacitor and an inductor.

13. The antenna according to claim 12, wherein the RLC circuit comprises a first RLC sub-circuit, a second RLC sub-circuit, and a third RLC sub-circuit and a fourth RLC sub-circuit, the switch is a single-pole four-throw switch configured to control the first matching circuit to select one or more of the first RLC sub-circuit, the second RLC sub-circuit, the third RLC sub-circuit, and the fourth RLC sub-circuit.

14. The antenna according to claim 1, further comprising a second grounding point, wherein the second grounding point is disposed in the receiving area, the second grounding point is electrically connected with a fifth contact point on the first frame and electrically connected with a sixth contact point on the main body;

the fifth contact point is disposed between the third contact point and the second frame, and the sixth contact point is disposed between the fourth contact point and a junction point connecting the main body and the second frame.

15. The antenna according to claim 14, wherein the fifth contact point is disposed at an end of the first frame adjacent to the second frame.

16. The antenna according to claim 1, further comprising a slit, wherein the slit is disposed on a side of the main body facing the receiving area and adjacent to the second frame, and/or the third frame, and an opening of the slit faces the receiving area.

17. A terminal device comprising a metal body, wherein the metal body comprises a main body and a frame structure connected with the main body;

the main body and the frame structure enclose a space to form a receiving area;

the frame structure is provided with two slots spaced apart on a bottom thereof;

the two slots divide the frame structure into a first frame, a second frame and a third frame;

the second frame and the third frame are disposed respectively on two sides of the first frame;

the first frame is provided with a first contact point and a third contact point;

the second frame is provided with a second contact point, the main body is provided with a fourth contact point; and the terminal device further comprises the antenna according to claim 1.

18. The terminal device according to claim 17, wherein the first matching circuit comprises an RLC circuit and a switch configured to control the RLC circuit, and the RLC circuit comprises a resistor, a capacitor and an inductor.

* * * * *